US008038742B2

(12) United States Patent
Shibata

(10) Patent No.: US 8,038,742 B2
(45) Date of Patent: Oct. 18, 2011

(54) FUEL FOR HOMOGENEOUS CHARGE COMPRESSION IGNITION ENGINE

(75) Inventor: Gen Shibata, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 411 days.

(21) Appl. No.: 12/402,628

(22) Filed: Mar. 12, 2009

(65) Prior Publication Data

US 2009/0229175 A1 Sep. 17, 2009

(30) Foreign Application Priority Data

Mar. 13, 2008 (JP) ..... 2008-063993

(51) Int. Cl.
*C10L 1/18* (2006.01)

(52) U.S. Cl. ..... 44/388; 44/448; 44/451; 585/14

(58) Field of Classification Search ..... 44/388, 44/448, 451; 585/14
See application file for complete search history.

(56) References Cited

U.S. PATENT DOCUMENTS

| | | | | |
|---|---|---|---|---|
| H1305 | H * | 5/1994 | Townsend et al. | 44/449 |
| 2003/0136047 | A1 | 7/2003 | Ketley et al. | |
| 2003/0162060 | A1 * | 8/2003 | Butler et al. | 429/17 |
| 2003/0213728 | A1 * | 11/2003 | Saitou et al. | 208/17 |
| 2005/0268883 | A1 | 12/2005 | Sobotowski et al. | |

FOREIGN PATENT DOCUMENTS

| | | | |
|---|---|---|---|
| GB | 735 134 | A | 8/1955 |
| JP | 2003-183679 | A | 7/2003 |
| JP | 2004-091657 | A | 3/2004 |
| JP | 2004-091658 | A | 3/2004 |
| JP | 2004-091659 | A | 3/2004 |
| JP | 2004-091660 | A | 3/2004 |
| JP | 2004-091661 | A | 3/2004 |
| JP | 2004-091662 | A | 3/2004 |
| JP | 2004-091663 | A | 3/2004 |
| JP | 2004-091664 | A | 3/2004 |
| JP | 2004-091665 | A | 3/2004 |
| JP | 2004-091666 | A | 3/2004 |
| JP | 2004-091667 | A | 3/2004 |
| JP | 2004-091668 | A | 3/2004 |
| JP | 2004-315604 | A | 11/2004 |

OTHER PUBLICATIONS

EP Search Report issued on Nov. 10, 2010 in EP Application No. 09 00 3629.

* cited by examiner

*Primary Examiner* — Cephia D Toomer
(74) *Attorney, Agent, or Firm* — Panitch Schwarze Belisario & Nadel LLP

(57) ABSTRACT

The present invention provides a fuel for homogeneous charge compression ignition engines, which can achieve a stable homogeneous charge compression ignition at a higher output. The fuel satisfies the following requirements (1), (2), (3), and (4):

(1) certain distillation characteristics between an initial boiling point (IBP): 0° C. or higher and 60° C. or lower; and an end point (EP): 250° C. or higher and 380° C. or lower;

(2) research octane number: 62 or greater and 85 or less;

(3) density at 15° C.: 0.700 g/cm$^3$ or higher and lower than 0.800 g/cm$^3$; and (4) Reid vapor pressure at 37.8° C.: 30 kPa or greater and lower than 65 kPa.

5 Claims, 1 Drawing Sheet

FUEL FOR HOMOGENEOUS CHARGE COMPRESSION IGNITION ENGINE

BACKGROUND OF THE INVENTION

The present invention relates to fuels for homogeneous charge compression ignition engines, more specifically to those having an excellent ignitability and capable of enhancing the engine output and widening the engine speed range as much as possible so as to improve the engine thermal efficiency.

Nowadays, two types of engines have been widely used, one of which is a spark ignition gasoline engine and the other of which is a compression ignition diesel engine.

For the spark ignition gasoline engine, fuel is injected into the intake port or the combustion chamber, and premixed gas of air fuel mixture is formed. Then the premixed gas is ignited by a spark plug and combusted. The fuel is required to have high vaporization and low auto-ignitability characteristics. Since the spark ignition gasoline engine emits nitrogen oxides (NOx), hydrocarbons (HC) and carbon monoxide, a three-way catalyst has been widely used for purifying these emissions. However, an exhaust gas purification system such as a three-way catalyst is only applicable to a range where the air-fuel ratio is in a very narrow range of stoichiometric air-fuel ratio and it is the causes of low thermal efficiency and poor fuel consumption comparing with the compression ignition diesel engine.

For the diesel engine, a diesel fuel is directly injected into the cylinder and mixed with the air during compression stroke. The air-fuel mixture is auto-ignited by increasing the temperature and pressure by piston compression. The diesel fuel is required to have high ignitability characteristics. The compression auto-ignition diesel engine is excellent in fuel consumption and thermal efficiency but has disadvantages of NOx and soot emissions caused by the heterogeneous air fuel mixture. Furthermore, severe control of an after treatment system such as an oxidation catalyst, NOx trap, a diesel particulate filter or an SCR system is required to reduce NOx and soot to meet political regulations.

Therefore, the conventional spark ignition gasoline engine can purify the exhaust gas to a certain extent but has problems regarding fuel consumption and thermal efficiency. On the contrary, the diesel engine is excellent in fuel consumption and has high thermal efficiency, but it has problems of emission of NOx. Therefore, a homogeneous charge compression ignition engine has been studied to achieve low NOx exhaust gas, excellent fuel consumption and high thermal efficiency.

For the homogeneous charge compression ignition engine, the fuel is injected into the intake port or combustion chamber at an injection pressure of 20 MPa or lower, which is extremely lower than the diesel engine and the fuel injection is completed at a crank angle of 60 degrees before the top dead center so that a premixed air-fuel mixture is combusted by auto-ignition but not by spark ignition. The homogeneous charge compression ignition engine takes a longer period to prepare a well-mixed air-fuel mixture in the cylinder, comparing with the diesel engine. Therefore, for the homogeneous charge compression ignition engine, a high temperature combustion region, the temperature of which is higher than 2200K, is not locally formed in the cylinder and this is the cause of low NOx emission characteristics (less than 10 ppm by mass) without a reduction catalyst. The thermal efficiency and fuel consumption of the homogeneous charge compression ignition engine are equivalent to those of the diesel engine.

Various fuels for the homogeneous charge compression auto-ignition combustion engine have been proposed, focusing on various indices such as ignitability, volatility, cetane number and octane number (for example, see Patent Documents 1 to 13 below) However, more optimum and suitable fuels for homogeneous charge compression ignition have been demanded from the point of engine performances.

Patent Document 1: Japanese Patent Laid-Open Publication No. 2004-919657

Patent Document 2: Japanese Patent Laid-Open Publication No. 2004-919658

Patent Document 3: Japanese Patent Laid-Open Publication No. 2004-919659

Patent Document 4: Japanese Patent Laid-Open Publication No. 2004-919660

Patent Document 5: Japanese Patent Laid-Open Publication No. 2004-919661

Patent Document 6: Japanese Patent Laid-Open Publication No. 2004-919662

Patent Document 7: Japanese Patent Laid-Open Publication No. 2004-919663

Patent Document 8: Japanese Patent Laid-Open Publication No. 2004-919664

Patent Document 9: Japanese Patent Laid-Open Publication No. 2004-919665

Patent Document 10: Japanese Patent Laid-Open Publication No. 2004-919666

Patent Document 11: Japanese Patent Laid-Open Publication No. 2004-919667

Patent Document 12: Japanese Patent Laid-Open Publication No. 2004-919668

Patent Document 13: Japanese Patent Laid-Open Publication No. 2004-315604

BRIEF SUMMARY OF THE INVENTION

For the homogeneous charge compression ignition (hereinafter referred to as "HCCI") engine, a well mixed air-fuel mixture is compressed by a piston which raises the temperature and pressure, and the auto-ignition is initiated. A commercially available gasoline has a disadvantage that when it is used in the HCCI engine, the driving range concerning engine speed and load can not be widened due to the poor ignitability of the gasoline. Whereas, since a commercially available gas oil has a disadvantage that it is poor in evaporation characteristics, it is difficult to premix the gas oil and air. When a current commercially available gasoline or gas oil is used as it is, it is difficult to allow it for HCCI combustion.

The homogeneous charge compression ignition engine (hereinafter referred to as "HCCI engine") requires a fuel which has (i) volatility and (ii) excellent ignitability. In order to accomplish the production of such a fuel, it is preferable to utilize the volatility of gasoline and the ignitability of gas oil effectively. As the result of extensively studying fuel suitable for HCCI combustion, the foregoing problems were solved, and the present invention has been accomplished.

That is, the present invention relates to a fuel for a homogeneous charge compression ignition engine satisfying the following requirements (1), (2) (3), and (4):

(1) distillation characteristics:

initial boiling point (IBP): 0° C. or higher and 60° C. or lower;

30 volume percent distillation temperature (T30): 70° C. or higher and 130° C. or lower;

50 volume percent distillation temperature (T50): 95° C. or higher and 200° C. or lower;

70 volume percent distillation temperature (T70): 100° C. or higher and 280° C. or lower;

90 volume percent distillation temperature (T90): 150° C. or higher and 330° C. or lower;

95 volume percent distillation temperature (T95): 230° C. or higher and 360° C. or lower;

end point (EP): 250° C. or higher and 380° C. or lower;

(2) research octane number: 62 or greater and 85 or less (3) density at 15° C.: 0.700 g/cm$^3$ or higher and lower than 0.800 g/cm$^3$; and (4) Reid vapor pressure at 37.8° C.: 30 kPa or greater and lower than 65 kPa.

EFFECTS OF THE INVENTION

The fuel of the present invention can be facilitated to be mixed with air due to the hydrocarbon contained in the low boiling point fraction and can accomplish a stable HCCI combustion at a higher output due to the ignitability of the hydrocarbon contained in the high boiling point fraction. Although a fuel with such characteristics can be produced, for example, by mixing gasoline and gas oil, a fuel adjusted to be in the ranges as defined by the present invention enables an HCCI engine to exhibit the original performances thereof.

BRIEF DESCRIPTION OF THE SEVERAL VIEWS OF THE DRAWINGS

The foregoing summary, as well as the following detailed description of the invention will be better understood when read in conjunction with the appended drawings. For the purpose of illustrating the invention, there are shown in the drawing embodiments which are presently preferred. It should be understood, however, that the invention is not limited to the precise arrangements and instrumentalities shown.

DETAILED DESCRIPTION OF THE INVENTION

The present invention will be described in more detail below.

The fuel of the present invention is suitable for a homogeneous charge compression ignition engine (hereinafter the homogeneous charge compression ignition is abbreviated as HCCI). The term "HCCI" herein denotes a combustion mode wherein fuel is combusted by auto-ignition under the following conditions (A), (B) and (C):

(A) fuel injection pressure: 20 MPa or lower;

(B) fuel injection position: the intake port and/or the direct injection into the cylinder; and (C) timing of completion of fuel injection: 60 degrees crank angle before the top dead center.

The HCCI is lower in (A) fuel injection pressure than conventional diesel engines and longer in (C) time period after the end of injection to the initiation of combustion to prepare a well-mixed air fuel mixture in the cylinder, than conventional diesel engines. Therefore, for the HCCI engine, a high temperature combustion region, the temperature of which is higher than 2200 k, is not locally formed in the cylinder and this is the cause of low NOx emission characteristics (less than 10 ppm by mass) without a reduction catalyst.

The homogeneous charge compression ignition combustion mode may also be referred to as HCCI (Homogeneous Charge Compression Ignition), PCCI (Premixed Charge Compression Ignition), PCI (Premixed Compression Ignition), CAI (Controlled Auto-Ignition) or AR (Active Radical (Combustion)).

The fuel of the present invention is suitably used in an HCCI engine. However, the fuel is also applicable to the following types of engines such as HCCI-SI gasoline engines (SI: spark ignition), HCCI-CI diesel engines (CI: compression ignition), and electric motored hybrid engines with HCCI, HCCI-SI and HCCI-DI engines.

The fuel of the present invention is required to have the following distillation characteristics (1):

(1) distillation characteristics:

initial boiling point (IBP): 0° C. or higher and 60° C. or lower;

30 volume percent distillation temperature (T30): 70° C. or higher and 130° C. or lower;

50 volume percent distillation temperature (T50): 95° C. or higher and 200° C. or lower;

70 volume percent distillation temperature (T70): 100° C. or higher and 280° C. or lower;

90 volume percent distillation temperature (T90): 150° C. or higher and 330° C. or lower;

95 volume percent distillation temperature (T95): 230° C. or higher and 360° C. or lower; and end point (EP): 250° C. or higher and 380° C. or lower.

Figure 1:
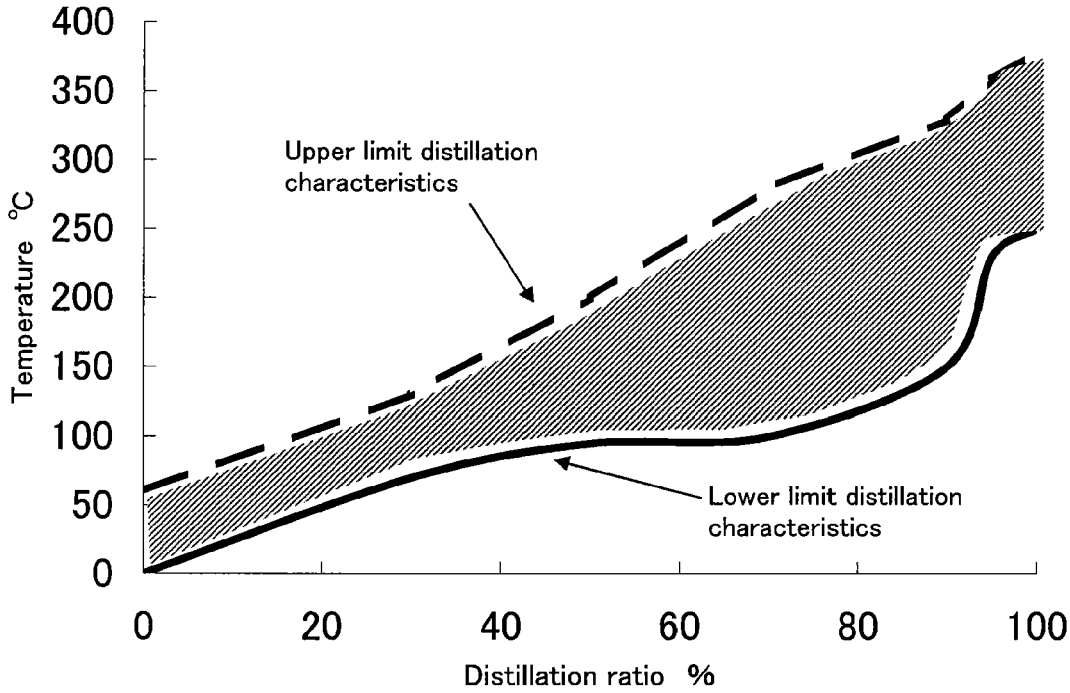
FIG. 1 shows the range of distillation characteristics defined by the present invention.

The shaded area in FIG. 1 is the range of the distillation characteristics defined by the present invention. A fuel with distillation characteristics which are higher in boiling points than the distillation characteristics range above the curve indicating the upper limit distillation characteristics of the present invention in FIG. 1 is extremely poor in volatility and thus difficult to be premixed with air. A fuel with distillation characteristics which are lower in boiling points than the distillation characteristics range below the curve indicating the lower limit distillation characteristics of the present invention in FIG. 1 is poor in ignitability and makes it difficult to carry out an HCCI driving.

Preferably, the fuel has the following distillation characteristics (1') if the running performance of an HCCI engine is desirously further enhanced:

(1') distillation characteristics:

initial boiling point (IBP): 0° C. or higher and 50° C. or lower;

30 volume percent distillation temperature (T30): 70° C. or higher and 110° C. or lower;

50 volume percent distillation temperature (T50): 95° C. or higher and 150° C. or lower;

70 volume percent distillation temperature (T70): 100° C. or higher and 250° C. or lower;

90 volume percent distillation temperature (T90): 150° C. or higher and 330° C. or lower;

95 volume percent distillation temperature (T95): 230° C. or higher and 360° C. or lower; and end point (EP): 250° C. or higher and 380° C. or lower.

The distillation characteristics used herein denotes the value measured in accordance with JIS K 2254 "Petroleum products-Determination of distillation characteristics".

The fuel of the present invention is required to have a research octane number satisfying the following requirement (2):

(2) research octane number: 62 or greater and 85 or less.

The research octane number of the fuel is necessarily 62 or greater and 85 or less. A fuel with a research octane number of greater than 85 is poor in ignitability and thus fails to increase the engine speed of an HCCI engine. For example, a regular gasoline with a research octane number of 92 is not preferable because an HCCI engine can not be driven at a higher load. A fuel with a research octane number of less than 62 is not also preferable because an HCCI engine can not be driven at a higher load.

The research octane number used herein denotes the value measured in accordance with JIS K 2280 "Petroleum products-Determination of octane number, cetane number and calculation of cetane index".

The fuel of the present invention is required to have a density satisfying the following requirement (3):

(3) density at 15° C.: 0.700 g/cm$^3$ or higher and lower than 0.800 g/cm$^3$.

The density at 15° C. of the fuel is necessarily 0.700 g/cm$^3$ or higher and lower than 0.800 g/cm$^3$, preferably 0.730 g/cm$^3$ or higher and lower than 0.780 g/cm$^3$. A fuel with a density at 15° C. of lower than 0.700 g/cm$^3$ is not preferable because it is high in vapor pressure and thus vaporized in distribution pipes with heat from the engine, possibly resulting in a failure of appropriate driving of an HCCI engine. A fuel with a density at 15° C. of higher than 0.800 g/cm$^3$ is not also preferable because it is poor in volatility and causes deterioration in fuel consumption and heat efficiency due to the large amount of unburnt hydrocarbons discharged when the engine is driven at a higher speed.

The density at 15° C. used herein denotes the value measured in accordance with JIS K 2249 "Crude petroleum and petroleum products-Determination of density and petroleum measurement tables based on a reference temperature (15° C.)".

The fuel of the present invention is required to have a Reid vapor pressure (RVP) satisfying the following requirement (4):

(4) Reid vapor pressure at 37.8° C.: 30 kPa or higher and 65 kPa or lower.

The Reid vapor pressure of the fuel is necessarily 30 kPa or higher and 65 kPa or lower. A fuel with a Reid vapor pressure of higher than 65 kPa is not preferable because it is discharged in the form of evaporated gas from a fuel tank and thus causes the generation of photochemical smog. A fuel with a Reid vapor pressure of lower than 30 kPa is not also preferable because it is poor in volatility and thus the engine may not be started up. Even though the engine is started up, such a fuel has a disadvantage that it causes a large cycle variation in torque and takes a time to stabilize the operation of the engine. If it is desirous to restrain the fuel from being formed into evaporated gas and improve the startability of an engine, the Reid vapor pressure is preferably 45 kPa or higher and lower than 60 kPa.

The Reid vapor pressure used herein denotes the value measured in accordance with JIS K 2258 "Crude petroleum and petroleum products-Determination of vapor pressure-Reid method".

There is no particular restriction on the sulfur content of the fuel. However, the sulfur content is preferably 10 ppm by mass or less, and with the objective of keeping the performances of a catalyst in a high level, more preferably 5 ppm by mass, most preferably 1 ppm by mass or less. A sulfur content of more than 10 ppm by mass is not preferable because an exhaust gas-purifying catalyst equipped in an engine is poisoned with sulfur, resulting in a poor exhaust gas-purifying performance. The sulfur content used herein denotes the value measured in accordance with JIS K 2541 "Crude oil and petroleum products-Determination of sulfur content".

The fuel of the present invention contains hydrocarbons as the main component but may further contain oxygenates such as ethers, alcohols, ketones, esters, and glycols. Examples of the oxygenates include methanol, ethanol, normalpropyl alcohol, isopropyl alcohol, normalbutyl alcohol, isobutyl alcohol, dimethyl ether, diisopropyl ether, methyl-tert-butyl ether (MTBE), ethyl-tert-butyl ether (ETBE), tert-amyl methyl ether (TAME), tert-amyl ethyl ether, fatty acid methyl ester, and fatty acid ethyl ester.

The fuel of the present invention can reduce unburnt hydrocarbon (HC) and fine particulate matters due to the presence of the foregoing oxygenates. When the fuel contains a biomass-originating oxygenate, it contributes to reduce carbon dioxide. However, as the case may be, the oxygenates cause an increase in nitrogen compounds. Therefore, the content of the oxygenates is preferably 5 percent by mass or less in terms of oxygen on the basis of the total mass of the fuel.

There is no particular restriction on the base oil of the fuel of the present invention as long as the fuel characteristics described above can be attained. For example, the base oil may be any one or more of fuel base stocks selected from naphtha fractions produced by atmospheric distillation of crude oil (full-range naphtha); light fractions of naphtha (light naphtha); heavy fractions of naphtha (heavy naphtha); desulfurized full-range naphtha produced by desulfurization of full-range naphtha; desulfurized light naphtha produced by desulfurization of light naphtha; desulfurized heavy naphtha produced by desulfurization of heavy naphtha; isomerized gasolines produced by converting light naphthas to isoparaffin in an isomerization unit; alkylates produced by addition (alkylation) of lower olefins to hydrocarbons such as isobutane; reformed gasolines produced by a catalytic reforming process; raffinates which are residues produced by extracting aromatic components from reformate; light reformates that are light fractions of reformate; middle reformates that are middle fractions of reformate; heavy reformates that are heavy fractions of reformate; cracked gasolines produced by catalytic cracking or hydrocracking; light fraction of cracked gasolines; heavy fraction of cracked gasolines; straight gas oils and straight kerosene produced through an atmospheric distillation unit for crude oil; vacuum gas oils produced by processing straight heavy oil or residue produced through an atmospheric distillation unit, in a vacuum distillation unit; catalytically cracked or hydrocracked gas oils and kerosenes produced by catalytically cracking or hydrocracking vacuum heavy gas oils or desulfurized heavy oils; hydrorefined gas oils, hydrodesulfurized gas oils or hydrorefined kerosenes produced by hydrorefining the foregoing petroleum hydrocarbons; and naphtha fractions, kerosene fractions and gas oil fractions of GTL (Gas to liquids) produced by FT (Fischer-Tropsch) synthesizing natural gas that have been decomposed to carbon monoxide or hydrogen.

The fuel of the present invention may contain known fuel additives if necessary. Examples of such fuel additives include friction modifiers such as amide compounds of carboxylic acids and alcohol amines; detergent-dispersants such as succinimide, polyalkyl amine, and polyether amine; antioxidants such as N,N'-diisopropyl-p-phenylene diamine, N,N'-diisobutyl-p-phenylene diamine, 2,6-di-t-butyl-4-methyl phenol and hindered phenols; metal deactivators such as amine carbonyl condensation compounds, for example, N,N'-disalicylidene-1,2-diamino propane; surface ignition inhibitors such as organic phosphorus compounds; anti-icing agents such as polyhydric alcohols and ethers thereof; combustion improvers such as alkali or alkaline metal salts of organic acids and sulfuric esters of higher alcohols; anti-static additives such as anionic, cationic, and amphoteric surface active agents; coloring agents such as azo dye; rust inhibitors such as organic carboxylic acids, their derivatives and alkenyl succinic acid esters; water draining agents such as sorbitan esters; cetane number improvers such as nitrate esters and organic peroxides; lubricity improvers such as carboxylic acid-, ester-, alcohol- and phenol-based lubricity improvers; silicone-based defoaming agents; cold flow improvers such as ethylene vinyl acetate copolymers and alkenylsuccinic imides; markers such as quinizarin and coumarin; and odorants. These additives may be added alone or in combination and are desirously added so that the total amount of these additives is 0.5 percent by mass or less, more preferably 0.2 percent by mass on the basis of the total amount of the fuel. The total amount of the additives denotes the amount in terms of their effective components.

EXAMPLES

Hereinafter, the present invention will be described in more detail by way of the following examples and comparative examples, which should not be construed as limiting the scope of the invention.

(1) Engine Used in the Examples (Engine Specification)

Type of Engine: in-line 4 cylinder HCCI engine with a displacement of 1998 CC and a compression ratio of 15. The engine specifications are described in the document "SAE2006-01-0207" (published in April, 2006).

The HCCI engine has a supercharger installed in the intake pipe, and an experiment for evaluating homogeneous charge compression ignition combustion was carried out in the examples and comparative examples under the following conditions.

(2) Conditions of the Experiment in the Examples and Comparative Examples

Measurement for the examples and comparative examples was carried out under the following experiment conditions A and B.

(2-1) Driving Conditions Common in Experiment Conditions A and B a) Boost pressure: 130 kPa (absolute pressure)

b) Intake temperature: 65° C.

(2-2) Driving Conditions in Experiment A

The engine was driven at an engine speed of 1500 rpm and a maximum pressure rise rate of 600 kPa/deg. Under these driving conditions, the experiment A was carried out to measure the torque and a period between 10 percent high temperature heat release combustion and 90 percent thereof defined as "combustion period" (unit: crank angle).

(2-3) Driving Conditions in Experiment B

The engine was driven at an engine speed of 1500 rpm and an engine torque of 70 Nm to measure the maximum pressure rise rate and the amount of nitrogen oxide emission.

(3) Fuels Used in the Examples and Comparative Examples

Properties of the fuels used in the examples and comparative examples are listed in Tables 1 and 2 below. The fuels of Comparative Examples 1 to 3 and Examples 1 to 5 were prepared by mixing the regular gasoline of Comparative Example 4 with No. 2 gas oil and the blend ratios thereof are set forth in the lower column. Similarly, the fuels of Comparative Examples to 7 and Examples 6 to 10 were prepared by mixing the regular gasoline of Comparative Example 4 with No. 3 gas oil. An engine performance test was carried out using these fuels under experiment conditions A and B.

TABLE 1

| | | | Comparative Example 1 | Comparative Example 2 | Comparative Example 3 | Example 1 | Example 2 | Example 3 | Example 4 | Example 5 |
|---|---|---|---|---|---|---|---|---|---|---|
| Octane number | | RON | less than 60 | 59.0 | 61.5 | 65.5 | 69.5 | 74.0 | 78.0 | 83.5 |
| Density@15° C. | | g/cm$^3$ | 0.8111 | 0.8025 | 0.7938 | 0.7852 | 0.7766 | 0.7674 | 0.758 | 0.7484 |
| RVP@37.8° C. | | kPa | 14.0 | 21.5 | 28.0 | 34.5 | 40.5 | 45.5 | 50.0 | 53.5 |
| Distillation characteristics | IBP | ° C. | 56.0 | 49.5 | 46.0 | 43.5 | 40.5 | 40.0 | 38.0 | 35.5 |
| | 5% | ° C. | 88.5 | 71.5 | 63.5 | 59.0 | 54.0 | 51.5 | 52.0 | 51.0 |
| | 10% | ° C. | 118.5 | 90.5 | 77.5 | 71.0 | 64.0 | 60.5 | 59.5 | 58.0 |
| | 20% | ° C. | 176.5 | 133.0 | 108.0 | 95.0 | 82.0 | 75.0 | 72.0 | 69.5 |
| | 30% | ° C. | 224.0 | 179.5 | 141.0 | 121.0 | 101.5 | 91.0 | 85.5 | 81.0 |
| | 40% | ° C. | 257.0 | 229.5 | 185.0 | 154.0 | 123.0 | 109.0 | 100.5 | 93.5 |
| | 50% | ° C. | 275.5 | 262.5 | 236.0 | 192.0 | 148.0 | 127.5 | 115.5 | 107.5 |
| | 60% | ° C. | 288.0 | 281.0 | 269.5 | 228.0 | 186.5 | 151.0 | 132.5 | 121.0 |
| | 70% | ° C. | 300.5 | 295.0 | 288.5 | 268.0 | 247.5 | 189.0 | 155.5 | 137.0 |
| | 80% | ° C. | 314.5 | 310.0 | 305.5 | 295.5 | 285.5 | 262.0 | 195.0 | 159.5 |
| | 90% | ° C. | 333.0 | 330.0 | 328.0 | 320.0 | 312.0 | 303.5 | 286.0 | 206.0 |
| | 95% | ° C. | 348.0 | 346.5 | 345.0 | 337.5 | 330.0 | 324.5 | 315.5 | 295.0 |
| | 97% | ° C. | 358.0 | 357.0 | 355.5 | 348.0 | 340.5 | 336.0 | 330.0 | 318.0 |
| | EP | ° C. | 360.0 | 358.0 | 357.0 | 353.0 | 349.0 | 345.0 | 337.5 | 319.0 |
| Regular gasoline | | vol % | 20 | 30 | 40 | 50 | 60 | 70 | 80 | 90 |
| No. 2 gas oil | | vol % | 80 | 70 | 60 | 50 | 40 | 30 | 20 | 10 |
| No. 3 gas oil | | vol % | — | — | — | — | — | — | — | — |

TABLE 2

| | | | Comparative Example 5 | Comparative Example 6 | Comparative Example 7 | Example 6 | Example 7 | Example 8 | Example 9 | Example 10 |
|---|---|---|---|---|---|---|---|---|---|---|
| Octane number | | RON | less than 60 | 60 | 62 | 65 | 68.5 | 73 | 77.5 | 83 |
| Density@15° C. | | g/cm$^3$ | 0.8014 | 0.794 | 0.7862 | 0.7787 | 0.7712 | 0.7631 | 0.7555 | 0.7472 |
| RVP@37.8° C. | | kPa | 14.0 | 21.0 | 28.0 | 35.0 | 40.0 | 45.0 | 49.0 | 53.5 |
| Distillation characteristics | IBP | ° C. | 57.0 | 52.0 | 46.5 | 43.5 | 40.5 | 40.0 | 37.0 | 36.0 |
| | 5% | ° C. | 93.0 | 78.0 | 67.0 | 61.5 | 56.0 | 54.5 | 50.0 | 50.0 |
| | 10% | ° C. | 120.5 | 98.0 | 81.5 | 73.5 | 66.0 | 63.0 | 58.5 | 57.5 |
| | 20% | ° C. | 159.5 | 134.0 | 110.5 | 97.0 | 84.0 | 78.0 | 71.5 | 69.0 |
| | 30% | ° C. | 183.5 | 164.5 | 139.0 | 121.5 | 104.0 | 94.0 | 85.5 | 80.5 |
| | 40% | ° C. | 207.0 | 188.5 | 165.5 | 145.0 | 124.5 | 112.0 | 100.5 | 93.5 |
| | 50% | ° C. | 232.5 | 215.5 | 190.5 | 168.5 | 146.5 | 130.0 | 116.0 | 107.0 |
| | 60% | ° C. | 256.0 | 243.0 | 222.0 | 197.0 | 172.0 | 150.5 | 132.0 | 121.0 |
| | 70% | ° C. | 277.5 | 269.0 | 254.5 | 230.0 | 205.5 | 175.0 | 153.5 | 136.5 |
| | 80% | ° C. | 297.0 | 292.0 | 284.0 | 269.0 | 253.5 | 218.0 | 181.0 | 156.5 |
| | 90% | ° C. | 320.5 | 317.0 | 312.0 | 304.5 | 297.0 | 283.5 | 247.0 | 188.0 |
| | 95% | ° C. | 338.5 | 336.0 | 331.5 | 325.0 | 318.5 | 313.0 | 297.0 | 246.0 |
| | 97% | ° C. | — | 347.5 | 344.0 | 338.0 | 332.0 | 327.5 | 316.0 | 287.5 |
| | EP | ° C. | 348.5 | 347.5 | 345.0 | 342.0 | 338.5 | 333.5 | 324.5 | 303.5 |
| Regular gasoline | | vol % | 20 | 30 | 40 | 50 | 60 | 70 | 80 | 90 |
| No. 2 gas oil | | vol % | — | — | — | — | — | — | — | — |
| No. 3 gas oil | | vol % | 80 | 70 | 60 | 50 | 40 | 30 | 20 | 10 |

(4) Results of the Experiments

The results of the experiments are set forth in Table 3 below.

Mixtures of the regular gasoline and the gas oil enable driving with a suppressed maximum pressure rise rate. For example, the maximum pressure rise rate of the regular gasoline at 1500 rpm and 70 Nm was 910 kPa/deg. However, the fuel of Example 3 containing 30 percent of No. 2 gas oil was able to hold the maximum pressure rise rate down to 500 kPa/deg. A further increase in the mix ratio of the gas oil results in an increase in the maximum pressure rise rate (Comparative Examples 1, 2, 3, 5, 6, and 7). As the result, all of the fuels of Examples 1 to 10 according to the present invention enabled driving at a maximum pressure rise rate of 700 kPa/deg or lower.

TABLE 3

| Experiment conditions | | | Comparative Example 1 | Comparative Example 2 | Comparative Example 3 | Example 1 | Example 2 | Example 3 | Example 4 | Example 5 | Comparative Example 4 |
|---|---|---|---|---|---|---|---|---|---|---|---|
| A | Torque | Nm | 45 | 59 | 75 | 95 | 118 | 135 | 113 | 90 | 68 |
| A | Combustion period | CA deg | 14.5 | 15.1 | 16.4 | 18.5 | 21.1 | 23 | 20.7 | 19 | 15.5 |
| B | Maximum pressure rise rate | kPa/deg | not driven | 1100 | 820 | 640 | 550 | 500 | 530 | 600 | 910 |
| B | NO*x* emission | ppm | not driven | 320 | 110 | 30 | 10 or less | 10 or less | 10 or less | 10 or less | 25 |

| Experiment conditions | | | Comparative Example 5 | Comparative Example 6 | Comparative Example 7 | Example 6 | Example 7 | Example 8 | Example 9 | Example 10 |
|---|---|---|---|---|---|---|---|---|---|---|
| A | Torque | Nm | 47 | 62 | 79 | 100 | 122 | 137 | 118 | 94 |
| A | Combustion period | CA deg | 14.7 | 15.4 | 17.5 | 19.8 | 22.1 | 24 | 21.5 | 19 |
| B | Maximum pressure rise rate | kPa/deg | not driven | not driven | 920 | 670 | 580 | 540 | 560 | 640 |
| B | NO*x* emission | ppm | not driven | not driven | 140 | 40 | 10 or less | 10 or less | 10 or less | 10 or less |

(4-1) Results of the Experiment on the Torque and Combustion Period Measured Under Experiment Conditions A The combustion period was short and the maximum torque was only 68 Nm when the regular gasoline of Comparative Example 4 was used. However, an increase in the mix ratio of gas oil prolongs the combustion period and increases the maximum torque. However, a too much increase in the mix ratio of gas oil facilitates the ignition of fuel too much, and the torque measured at 600 kPa/deg would be small. The fuels of Examples 1 to 10 can provide a practical torque which is 80 Nm or greater under experiment conditions A and can increase the torque by 32 to 100 percent comparing with the fuel of Comparative Example 4.

Figure 2:
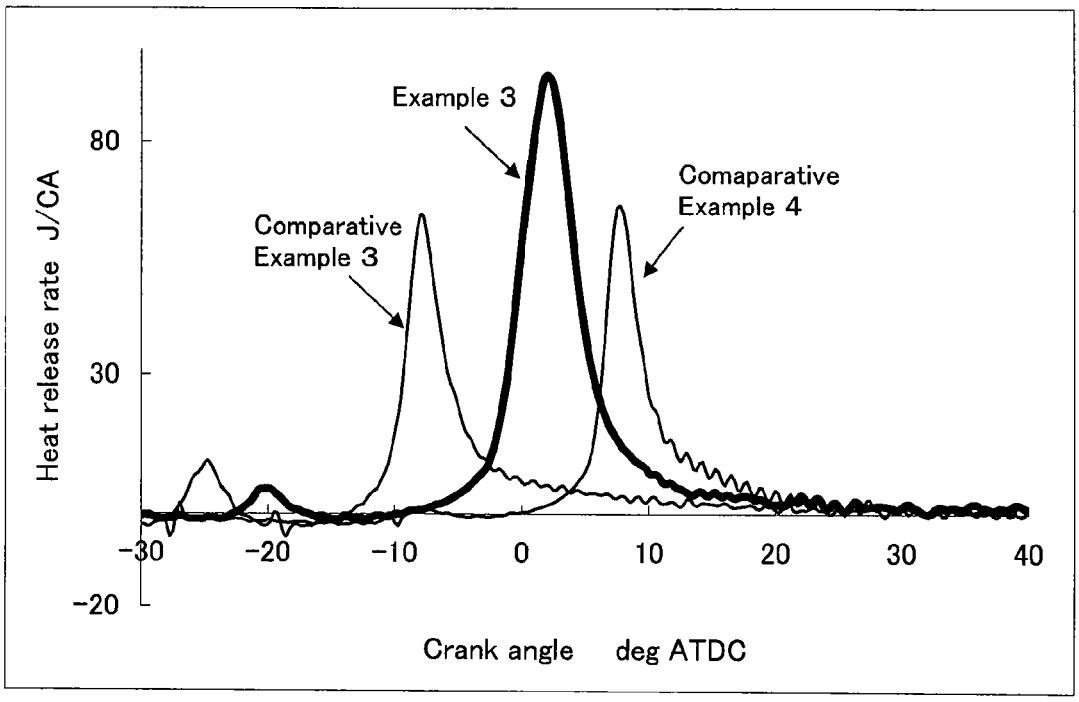
FIG. 2 show the rate of heat release of each of Example 1, Comparative Example 3 and Comparative Example 4.

(4-2) Results of the Experiment on the Maximum Pressure Rise Rate and the NOx (Nitrogen Oxide) Emission Under Experiment Conditions B (4-3) Comparison in Rate of Heat Release FIG. 2 shows the rates of heat release of the fuels of Example 3 and Comparative Example 4 under experiment conditions A. As apparent from FIG. 2, the fuel of Example 3 combusted with a heating value which is far larger than the fuels of Comparative Examples 3 and 4. All of the fuels of the other examples combusted like that of Example 3 and can significantly improve the engine performances comparing with the conventional gasolines and gas oils.

I claim:

1. A fuel for a homogeneous charge compression ignition engine satisfying the following requirements (1), (2), (3), and (4):

(1) distillation characteristics:

initial boiling point (IBP): 0° C. or higher and 60° C. or lower;

30 volume percent distillation temperature (T30): 70° C. or higher and 130° C. or lower;

50 volume percent distillation temperature (T50): 95° C. or higher and 200° C. or lower;

70 volume percent distillation temperature (T70): 100° C. or higher and 280° C. or lower;

90 volume percent distillation temperature (T90): 150° C. or higher and 330° C. or lower;

95 volume percent distillation temperature (T95): 230° C. or higher and 360° C. or lower; and end point (EP): 250° C. or higher and 380° C. or lower;

(2) research octane number: 62 or greater and 85 or less (3) density at 15° C.: 0.700 g/cm$^3$ or higher and lower than 0.800 g/cm$^3$; and (4) Reid vapor pressure at 37.8° C.: 30 kPa or greater and lower than 65 kPa.

2. A fuel for a homogeneous charge compression ignition engine according to claim 1, satisfying the following requirements (1), (2), (3), and (4):

(1) distillation characteristics:

initial boiling point (IBP): 0° C. or higher and 50° C. or lower;

30 volume percent distillation temperature (T30): 70° C. or higher and 110° C. or lower;

50 volume percent distillation temperature (T50): 95° C. or higher and 150° C. or lower;

70 volume percent distillation temperature (T70): 100° C. or higher and 250° C. or lower;

90 volume percent distillation temperature (T90): 150° C. or higher and 330° C. or lower;

95 volume percent distillation temperature (T95): 230° C. or higher and 360° C. or lower; and end point (EP): 250° C. or higher and 380° C. or lower (2) research octane number: 62 or greater and 85 or less (3) density at 15° C.: 0.730 g/cm$^3$ or higher and lower than 0.780 g/cm$^3$; and (4) Reid vapor pressure at 37.8° C.: 45 kPa or greater and lower than 60 kPa.

3. The fuel for a homogeneous charge compression ignition engine according to claim 1, wherein the sulfur content of the fuel is 10 ppm by mass or less.

4. The fuel for a homogeneous charge compression ignition engine according to claim 1, comprising oxygenates selected from the group consisting of methanol, ethanol, normalpropyl alcohol, isopropyl alcohol, normalbutyl alcohol, isobutyl alcohol, dimethyl ether, diisopropyl ether, methyl-tert-butyl ether (MTBE), ethyl-tert-butyl ether (ETBE), tert-amyl methyl ether (TAME), tert-amyl ethyl ether, fatty acid methyl ester, and fatty acid ethyl ester.

5. The fuel for a homogeneous charge compression ignition engine according to claim 1, wherein the fuel is also applicable to the following types of engines selected from the group consisting of HCCI-SI gasoline engines (SI: spark ignition), HCCI-CI diesel engines (CI: compression ignition), and electric motored hybrid engines with HCCI, HCCI-SI and HCCI-DI engines.

* * * * *